United States Patent [19]

Anderson et al.

[11] Patent Number: 4,569,273

[45] Date of Patent: Feb. 11, 1986

[54] THREE-WAY PROPORTIONAL VALVE

[75] Inventors: Gerald C. Anderson, Oconomowoc; Kenneth F. Frank, West Bend, both of Wis.

[73] Assignee: Dynex/Rivett Inc., Pewaukee, Wis.

[21] Appl. No.: 514,641

[22] Filed: Jul. 18, 1983

[51] Int. Cl.[4] ..... F15B 13/043

[52] U.S. Cl. ..... 91/447; 137/596.2; 137/625.63; 137/625.64

[58] Field of Search ..... 137/596.2, 628.63, 625.64; 91/447

[56] References Cited

U.S. PATENT DOCUMENTS

| | | | |
|---|---|---|---|
| 3,653,409 | 4/1972 | Brannon | 137/625.63 |
| 3,875,849 | 4/1975 | Patel | 137/625.64 X |
| 4,011,891 | 3/1977 | Knutson et al. | 137/625.64 X |
| 4,266,572 | 5/1981 | Schuttenberg et al. | 137/625.64 X |
| 4,290,447 | 9/1981 | Knutson | 91/447 X |
| 4,376,453 | 3/1983 | Moretti et al. | 137/625.64 |

OTHER PUBLICATIONS

Society of Automotive Engineers Technical Paper Series, No. 780747, Sep. 1978, Kisnor Patel, "Pressure Compensated Electro-Hydraulic Proportional Flow Control Valve".

*Primary Examiner*—Gerald A. Michalsky

*Attorney, Agent, or Firm*—John J. Byrne; Bradford E. Kile; Kevin M. O'Brien

[57] ABSTRACT

An electrohydraulic proportional valve wherein an electromagnetic force motor sends a mechanical signal to a pilot actuator which moves a main spool. The pilot actuator includes a pilot spool slidably received in a pilot sleeve. A feedback spool which is movable with the main spool has a camming surface against which the pilot sleeve rides. A load check valve is provided that isolates the load pressure from system pressure when desired.

9 Claims, 5 Drawing Figures

FIG. 2
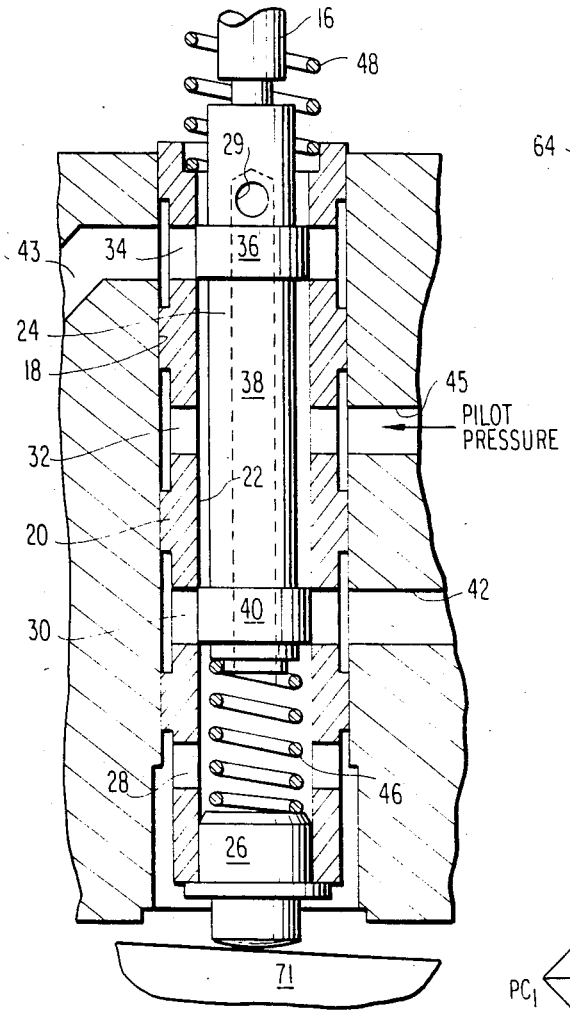
FIG. 3
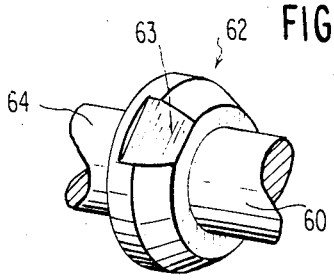
FIG. 4a
(PRIOR ART)
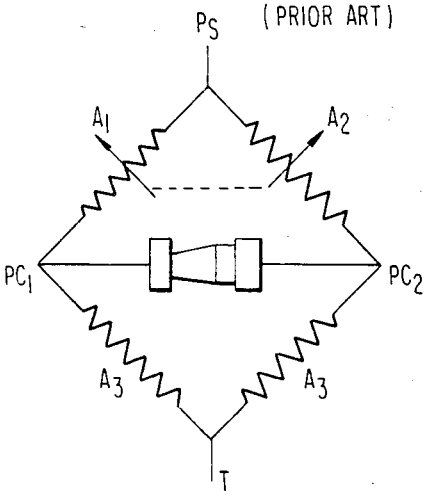
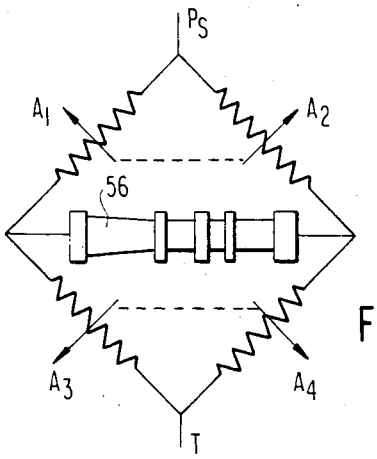
FIG. 4b

THREE-WAY PROPORTIONAL VALVE

TECHNICAL FIELD

This invention relates to electrohydraulic proportional valves suitable for use in selective control valve applications. In particular, it relates to a three-way, electrohydraulic flow control valve with continuously variable output flow proportional to an electrical signal from an operator.

BACKGROUND OF THE PRIOR ART

The prior art is aware of electrohydraulic control devices. One example of the prior art is disclosed in assignee's U.S. Pat. No. 4,290,447, issued Sept. 2, 1981. In that patent, a hydraulic bridge is established having two fixed orifices and two variable orifices. Here, additional advantages are obtained by establishing a bridge with four variable orifices and a load holding check.

OBJECTS OF THE INVENTION

It is a general object of the invention to provide an electrohydraulic proportional valve unit with improved fluid control functions.

It is a particular object of the invention to provide such a valve having a "float" position wherein a load member, for example, which is traversing ground contours, can float or move therewith.

It is a further object of the invention to provide a means of opening a load-holding check valve depending on the main spool position.

It is a still further object of the invention to provide such a valve in which battery rundown or line losses do not limit the ability of the pilot actuator to move the main spool to its center position.

Other objects and advantages of the present invention will become apparent from the appended detailed description of a preferred embodiment taken in conjunction with the accompanying in which:

BRIEF DESCRIPTION OF THE DRAWINGS

FIG. 2 is an enlarged cross-section of a portion of FIG. 1;

FIG. 3 is a perspective of one element of its main control spool;

FIGS. 4*a* and 4*b* are schematics showing the principles of operation of the hydraulic network as compared to the prior art.

DETAILED DESCRIPTION OF PREFERRED EMBODIMENT OF THE INVENTION

Figure 1:
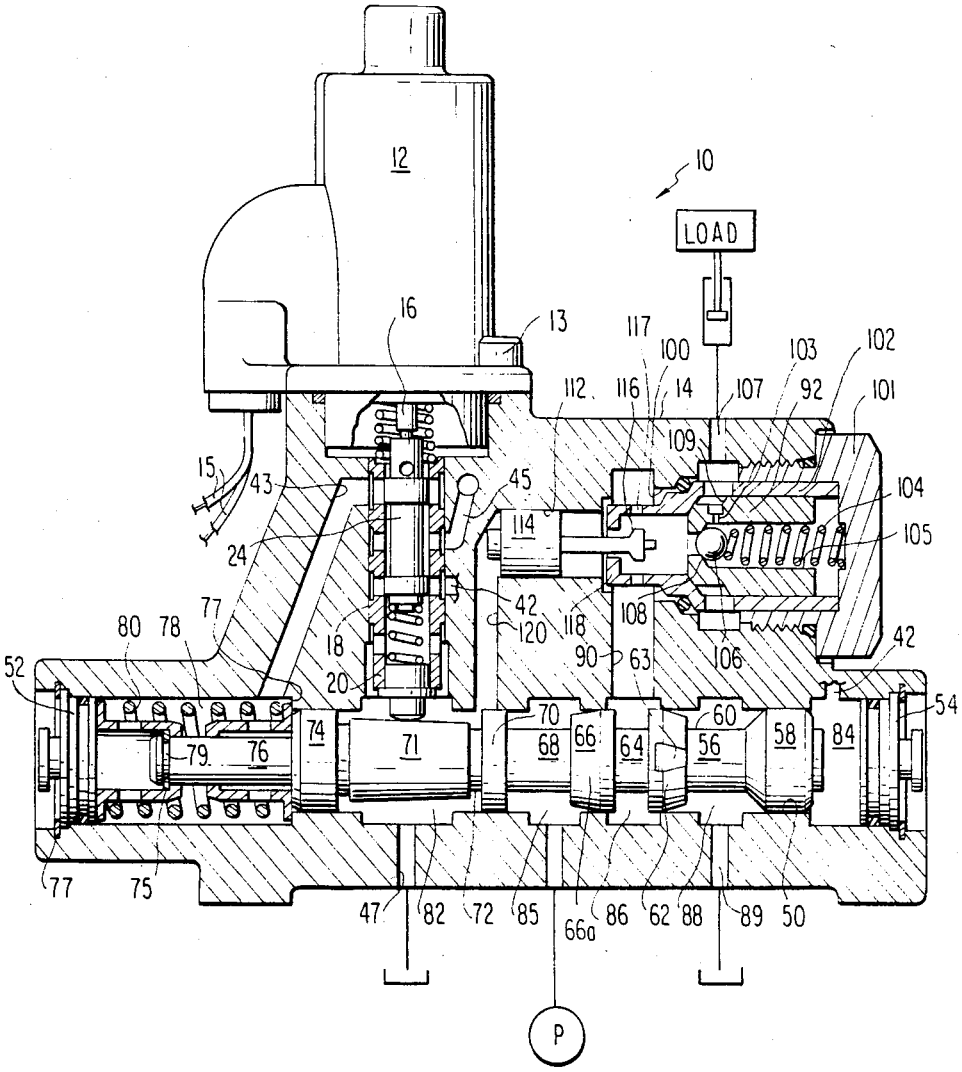
FIG. 1 is a cross-sectional view, partially diagrammatic, of the structure of this invention.

Referring now to the drawings wherein like elements are indicated by like numerals, the numeral 10 refers generally to the valve of this invention. The valve is comprised generally of a force motor 12 and a pilot-controlled valve assembly and housing 14. The force motor 12 is received by the housing 14 and can be secured and detached by mounting screws such as 13.

The electromagnetic force motor 12 is a bi-directional device producing a linear output displacement proportional to the magnitude and polarity of an electric signal. The magnetic circuit of the force motor contains permanent magnets which create a polarizing magnetic flux in working air gaps. The coil flux interacts with a permanent magnet flux to move the armature in one direction or the other depending on the polarity of the electric signal. The armature of the force motor is spring-centered so that it returns to a neutral position upon the loss of the electrical signal. The armature is suspended from the rest of the force motor assembly. Thus, there are no rubbing contacts between the armature and the components. Hysteresis is reduced due to the elimination of frictional forces acting on the armature. Additionally, the force motor cavity is flooded with oil in order to eliminate the use of small dynamic seals which would be subjected to a large number of cycles and which would place undesired frictional forces on the armature assembly. The force motor 12 has an output member 16 which moves in accordance with an electrical signal transmitted to the force motor by way of the electrical conduits 15 which lead to an operator's position.

The housing 14 has a pilot control receiving bore 18 in which a pilot control sleeve 20 is slidably received. The pilot control sleeve 20 has a central bore 22 slidably receiving a generally hollow pilot control spool 24. The upper end of the pilot spool is in engagement with the output member 16. There is an opening 29 formed at the upper end of spool 24. The lower end of sleeve 20 is closed by a follower plug 26. Intermediate its length, the sleeve 20 is formed with openings 28, 30, 32 and 34.

As best seen in FIG. 2, the pilot control spool 24 is formed with a land 36 having a width commensurate with opening 34, a reduced portion 38 and a second land 40 having a width commensurate with opening 30. The opening 32 is in communication with a passageway 45 leading to pilot control pressure source. The opening 34 is in communication with passageway 43. The opening 30 is in communication with the passageway 42. In interest of clarity passageway 42 is shown diagramatically. Passageway 42 leads to chamber 84 described below.

A spring 46 has its bottom resting on plug 26 and is disposed to urge spool 24 upwards into engagement with the force motor output member 16. A spring 48 urges the pilot sleeve downwardly against the feedback spool 71.

The housing 14 has a main bore 50 extending throughout its length. The bore 50 is enclosed at one end by a plug 52 and at its other end by plug 54. Between the plugs, the bore 50 slidably receives a main operating spool 56. From the right, the spool is provided with a land 58, a reduced portion 60, a land 62, a reduced portion 64, a land 66, a reduced portion 68, a land 70, a reduced portion 72 (having the truncated conical section 71), a land 74 and a spool extension 76.

Between plug 52 and land 74, a control chamber 78 is formed in which the extension 76 is received and to which the passageway 43 is communicated. A centering spring assembly 80 is secured about extension 76 so as to preload the spool 56 when there is no electrical signal (null) from the force motor 12. As seen in FIG. 1, the components are at this null position. Centering spring 80 is preloaded in the assembly. The spring is captured on the spool stem 76 between two cup-like spring guides. The left spring guide is prevented from moving to the left relative to the spool by retaining ring 75 in a groove 79 in the stem. The right-hand spring guide is prevented from moving to the right relative to the spool and stem because the spring guide rests against the spool land 74. The spring guides and preloaded spring are captured in the valve body by end plug 52 on the left and by a step 77 in valve body 14.

It should be noted that the space allotted for the spring guides and the preloaded spring by the valve body equals the dimension from the left end of the left-hand spring guide to the right end of the right-hand spring guide if the assembly were not in the valve body. The preload of the captured centering spring must be overcome whether the spool 56 is moved either to the right or to the left. The preload assembly 80 holds the main spool in its "null" position any time there is zero or equal hydraulic pressure acting on the ends of the main spool 56.

The reduced portion 72 of spool 56 forms a part of a chamber 82, the reduced portion 68 forms a part of chamber 85, the reduced portion 64 forms a part of chamber 86 and the reduced portion 60 forms a part of chamber 88. The chamber 88 is communicated with tank via passageway 89, the chamber 86 is communicated to a load-holding check valve assembly.

The housing 14 is also formed with a bore 100 which receives the load holding check valve assembly. The check valve assembly is held in place by a plug 101 which is threadably received at the outer end of bore 100. Within the bore 100 is a sleeve 102 that provides a seat for a poppet 92 intermediate its length. Poppet 92 has an inner bore 105 that receives the spring 104. Spring 104 urges check ball 106 against its valve seat 108. The interior chamber of the load-checking assembly is communicated to "load" pressures through the passageway 103 and the cylinder port diagrammatically shown at 107. Thus, when the poppet is seated because of load pressures and the bias of spring 104, fluid cannot drain from the pressurized side of the working cylinder.

A reduced bore extension 112, inwardly and axially of bore 100, receives a plunger 114. Plunger 114 is slidably received in bore 112 and has an arm 116 extending in the direction of the check ball 106. The plunger can reciprocate between the position shown in FIG. 1 to a position against annular flange 118 wherein check ba11 106 is displaced from its seat. Passageway 120 communicates the other side of plunger 114 to drain chamber 82 or to the pump pressure chamber 85 depending on the position of land 70. Openings 117 are provided about sleeve 102 to communicate the interior thereof to passageway 90.

When an electrical signal is applied to force motor 12, it moves pilot spool 24 an amount proportional to the electrical signal. For instance, when spool 24 is moved downwardly against the bias of spring 46; or upwardly by spring 46 the location of pilot spool 24 will determine whether pilot pressure is communicated to chamber 78 (to the left of the main spool) via passageway 43 or to chamber 84 (to the right of the main spool) via passageway 42. When the spool 24 moves downwardly, pilot pressure is transmitted to chamber 84 via passageway 42 and the main spool is moved to the left. When additional pressure is transmitted to chamber 78, the main spool moves to the right. The pilot control sleeve 20 operates similarly to that explained in U.S. Pat. No. 4,290,447, i.e, the pilot sleeve will move in the same direction as spool 24 to close the variable orifice which opens when the pilot spool is moved. In other words, the positional feedback employed in Pat. No. '447 is also used here. However, in Pat. No. '447, the ends of the piston that actuates the main spool are at tank pressure via fixed orifices A-3.

In the instant application, the pilot spool communicates pressures to the ends of the main spool and to tank through the *variable* orifices. For instance, when the spool moves downwardly, there is developed a variable orifice between upper surface of land 36 and opening 34 (A-3) and between upper surface of land 40 and opening 30 (A-2). When the spool moves upwardly a variable orifice is developed between the lower surface of land 36 and opening 34 (A-1); and the lower surface of land 40 and opening 30 (A-4). The schematic of this system can be seen best in FIG. 4*b*. In the proportional valve of Pat. No. '447, A-1 and A-2 are variable orifices and A-3 fixed. In the instant case, the orifices A-3 and A-4 are also variable. This precisely controls the position of the main spool. The structure shown herein provides a true four-way pilot control that positions the main spool in proportion to the electrical signal received from the force motor.

While the invention has an infinite number of positions and variable flows, the three basic positions of its components can be characterized as:

"Hold"—The position shown in FIG. 1, wherein the main spool 56 is in its spring-centered position. In hold, the left side of the load-holding check valve plunger 114 is connected to drain pressure and the right side is connected to tank via notch 63; therefore, the plunger tends to move away from the load holding check valve if there is a slight pressure at the tank port. The load-holding check valve is against its seat and blocks flow from the cylinder port. The load is held in position.

"Up"—The main spool is moved to the right. As land 66 moves right, flow passes through the load-holding check valve to the cylinder port 107. This flow moves the load against gravity or other loads.

"Down"—The main spool is moved to the left. In this position, system pressure in passageway 120 acts on the left side of the load-holding check valve plunger 114 causing it to move to the right wherein the plunger arm 116 upsets the ball 106 from its seat 108 against the bias of the check ball holding spring 104 opening the interior and back of poppet 92 to tank pressure through opening 117, passageway 90 and chamber 88. Passageway 103 restricts the flow of fluid from cylinder port 107 thus reducing pressure in the interior and back of poppet 92. Load pressure is present in cylinder port 107 and acts on relieved portion 109 of poppet 92 thus opening the load-holding check valve poppet 92. Poppet 92 moves to the right and the cylinder port 107 is opened to tank through the load-holding poppet and across land 62 of the main spool. Before the main spool 56 first begins to move to the left, pressure in passage 90 is metered to tank through the notches 63 on land 62. As the spool moves to the left, pressure from chamber 85 is metered to passageway 120 and plunger 114 by means of spool land 70. The load-holding check valve is caused to open and fluid in load port 107 is metered across land 62 through chamber 88 passageway 89 to tank. When the main spool has been moved carefully to the left, free flow is permitted between the load port 107 and tank. Therefore, gravity, acting on the load, permits the load to be lowered. When the load is resting on the ground, the load member is free to "float" up and down, as it traverses the ground contours.

In operation, signals are transmitted through lines 15 which will move output member 16. When output member 16 moves downwardly, it moves spool 24 downwardly causing land 36 to uncover opening 34 and land 40 to uncover opening 30. Pilot pressure in conduit 45 is isolated from conduit 43 and communicated through the metered orifice to conduit 42 leading to chamber 84 at the right of main spool 56. This pressure causes the main spool to move to the left. at the same time, chamber 78 is communicated to tank via the metered opening between the upper surface of land 36, opening 34, bore 29 and opening 28. Conversely, if output member 16 is moved upwardly, spool 24 moves upwardly and pilot pressure from conduit 45 is communicated to chamber 78 through the metered orifice between the lower surface of land 36 and opening 34 and chamber 84 is communicated to tank through the metered orifice between the lower surface of land 40, opening 30, and opening 28.

When the main spool is moved to the right, system or pump pressure is connected to the cylinder port 107 through the passage system that opens between land 66 and passageway 90 and through the load-holding check valve. Resulting flow depends on the amount of opening caused by the main spool motion and the pressure difference between the system pressure and the load pressure at the cylinder port 107. If the load pressure is constant, flow will be proportional to the electrical signal given by the force motor.

When the main spool 56 is moved to the left, system pressure is connected to the load-holding check valve plunger 114 via the opening created by land 70 uncovering passageway 120. The plunger opens the load-holding check ball 106 and load holding check poppet 92 permitting fluid to return to tank via the check valve opening, conduit 90 and the opening provided by the movement to the left of land 62.

Before the main spool 56 is moved to the left, the passage between the main spool and the load-holding check valve passage 90 is connected to tank through a small metering notch 63 of land 62 (See FIG. 3) allowing a bleed down of pressure to tank. As the main spool moves to the left, the load-holding check valve opens, which applies load pressure to the bleed down orifice. Then the main spool moves fully to the left allowing unrestricted flow to tank. If the load is constant, the flow to tank will be proportional to the electrical signal.

In many hydraulic systems, pressure to the valve is held constant by the pump. Referring to FIG. 1, for systems of this type, the pressure in chamber 85 will be constant. If load pressure at port 107 is constant, for a given input electrical signal to force motor 12, flow through the valve will be constant. As load pressure increases or decreases, flow through the valve also increases or decreases. Since it is desirable to have flow through the valve constant, many prior art devices provided an additional spool valve to maintain a constant pressure difference across the valve spool even though load pressure was varying. This is called pressure compensation. While pressure compensation devices accomplish the objective, it adds to the cost and size of an additional spool valve. In this invention a similar effect is accomplished by means of a combination of the contour of land 66 and taper 66*a*, the shape of chambers 85 and 86 and the means of supplying pressure to chambers 78 and 84.

When spool 56 moves to the right, fluid from pump P moves across land 66 and taper 66*a*. Because of the high fluid velocity and the contour of land 66 and taper 66*a*, and the shape of chambers 85 and 86, a force due to flow is generated on main operating spool 56. The flow forces are used and enhanced to provide the desirable effect of pressure compensation. These flow forces tend to move main operating spool toward a position of reduced opening for flow. Therefore as flow increases, due to reduced load pressure at 107, the flow forces urge spool 56 toward a closed position and the spool closes slightly. As flow decreases due to increased load pressure at 107, the flow forces urging spool 56 toward a closed position, decrease and the spool opens slightly. It should be understood that the characteristic or stiffness of the control system supplying control pressure to chambers 78 and 84 will affect the amount of spool opening or closing due to the flow forces. Summarizing, as flow tends to increase due to decreased load pressure, the main spool tends to close. As flow tends to decrease due to increased load pressure, the main spool tends to open. This effect tends to maintain a constant flow through the valve and in fact provides the pressure compensation prior art accomplished by means of an additional spool valve.

In describing the invention, reference has been made to a preferred embodiment and illustrative advantages of the invention. Those skilled in the art, however, and familiar with the instant disclosure of the subject invention, may recognize additions, deletions, modifications, substitutions and/or other changes which fall within the purview of the subject invention and claims.

We claim:

1. A proportional control valve comprising:

a valve housing having a main bore therethrough, means for forming opposite ends of said bore, a main spool, shorter in length than said bore slidably received in said bore, ends of said main spool respectively forms in combination with a corresponding end of said bore first and second pressure chambers at opposing sides of said main spool, said main spool being the only spool having any end thereof extending into or constituting a part of either one of said first and second pressure chambers, said valve housing having a first passageway communicating said bore with a source, a second passageway communicating said bore with a load, and a third passagway communicating said bore with tank, a force motor, a pilot control means responsive to signals received from said force motor for applying fluid pressure to one of said pressure chambers and thus moving said main spool in a direction away from the pressure chamber receiving said pressure and towards the other pressure chamber, a load check valve in said second passageway having a first position preventing fluid from flowing from said load to said third passageway and a second position permitting such flow, and moving means responsive to movement of said main spool toward said first pressure chamber for moving said check valve from said first position to said second position.

2. The apparatus of claim 1 wherein said housing includes a second bore, a pilot control valve reciprocally received in said second base; a source of pilot pressure fluid in communication with said second bore, a fourth passageway communicating said second bore to said first pressure chamber and a fifth passageway communicating said second bore to said second chamber, said pilot control valve includes first meter means responsive to a first signal from said force motor for metering said pilot pressure fluid to said first chamber while metering fluid from said second chamber to tank.

3. The apparatus of claim 2 wherein said pilot control valve includes second metering means responsive to a second signal from said force motor, opposite to said first signal, for metering said pilot pressure fluid to said second chamber while metering fluid from said first chamber to tank.

4. The apparatus of claim 3 further including limiting means for limiting the amount of fluid metered to said chambers so as to be proportional to the degree of signal from said force motor.

5. The apparatus of claim 1 wherein said moving means includes a plunger that opens said check valve when said spool moves into said first chamber.

6. The apparatus of claim 1 wherein first, second and third lands are formed on said main spool and spaced so that when said second land is moved to a first position to communicate said first passageway to second passageway, said first land isolates said third passageway, said first land isolates said third passageway from said second passageway and when said second land is moved to a second position that closes said first passageway from said second passageway, said first land communicates said third passageway to said second passageway.

7. The apparatus of claim 6 wherein said first land embodies a means for metering fluid.

8. The apparatus of claim 6 wherein said second land is tapered a portion of its length.

9. The apparatus of claim 6 wherein said housing is formed with a third bore, and that said moving means includes a piston slidably received in said third bore, said piston positioned to open said check valve when said spool is moved to said second position.

* * * * *